United States Patent [19]

Thrasher et al.

[11] Patent Number: 5,014,372

[45] Date of Patent: May 14, 1991

[54] SELF-ROTATING SPA JET ASSEMBLY

[75] Inventors: Lawrence E. Thrasher, Simi Valley; Gordon E. Olson, Rancho Palos Verdes; Garrett J. Burkitt, III, Simi Valley; Timothy E. Schmidt, Camarillo; Elias M. Haddad, Thousand Oaks; Susan Conti-Johnston, Simi Valley, all of Calif.

[73] Assignee: KDI American Products, Inc., Moorpak, Calif.

[21] Appl. No.: 421,465

[22] Filed: Oct. 13, 1989

[51] Int. Cl.[5] ..... A61H 33/02; E03C 1/02

[52] U.S. Cl. ..... 4/542; 4/541; 4/492; 128/66; 239/414; 239/428.5

[58] Field of Search ..... 4/541, 542-544, 4/492, 491; 239/428.5, 414, 261, 252, 255, 251; 128/66

[56] References Cited

U.S. PATENT DOCUMENTS

| | | | |
|---|---|---|---|
| 4,220,145 | 9/1980 | Stamp et al. | 4/542 |
| 4,387,854 | 6/1983 | Dupont | 4/541 X |
| 4,508,665 | 4/1985 | Spinnett | 4/542 X |
| 4,523,718 | 6/1985 | Pearson | 239/428.5 X |
| 4,530,467 | 7/1985 | Bueno | 239/428.5 X |
| 4,559,653 | 12/1985 | Mathews | 4/541 |
| 4,692,950 | 9/1987 | Henkin et al. | 4/542 |
| 4,715,071 | 12/1987 | Henkin et al. | 4/542 |

*Primary Examiner*—Henry K. Artis

*Attorney, Agent, or Firm*—Noel F. Heal

[57] ABSTRACT

A hydrotherapy jet assembly that produces rotating and pulsating streams of water and provides for user adjustable flow control, and user adjustable control of the speed of rotation independently of the flow control. The assembly includes a nozzle rotor supported for rotation in a generally cylindrical body, and a rotor retainer cage having a thrust plate that applies an axial retaining force to the rotor. The rotor has two internal passages that discharge water in directions that may be selected to produce a turning moment applied to the rotor. Fins may be incorporated into the rotor to produce or contribute to rotation. In all of the disclosed forms of the rotor, radial thrust components resulting from discharge of water through the two rotor passages cancel each other. The rotor is thereby balanced in directions transverse to its axis or rotation. Axial thrust components resulting from the discharge of water from the nozzle rotor are substantially balanced by the force of water entering the rotor. A brake washer is installed adjacent to the nozzle rotor and a compression spring applies a controllable braking force to the rotor to control its speed.

27 Claims, 7 Drawing Sheets

7b
7b
56.2
56.2
56.2
56.2
50.2

56.2
56.2
50.2

56.2
56.2
56.2
56.2
50.2

SELF-ROTATING SPA JET ASSEMBLY

BACKGROUND OF THE INVENTION

This invention relates generally to hydrotherapy apparatus, such as spas and hot tubs, and, more particularly, to water-driven rotatable jets for use in such apparatus. Hydrotherapy pools, tubs, spas and baths have wall openings through which streams of water, or a water and air mixture, are discharged into a heated body of water. Persons seated or reclining in the water may position themselves appropriately to receive a therapeutic benefit from massage by the incoming water streams. Each stream enters through a fixture that will be referred to in this specification as a spa jet, although it will be understood that fixtures of the same type may be installed in bathtubs, hot tubs and other similar equipment.

Spa jets are typically made to be adjustable both in the direction in which the water is discharged, and in the rate of flow of the water. There may also be some control over the proportion of air in the water. Although fixtures of this general type have been in use for some years, it has only recently been recognized that additional therapeutic benefit may be obtained from a constantly moving stream of water. Various techniques have been proposed to achieve this end, but all have been unsatisfactory to some degree.

For example, U.S. Pat. No. 4,692,950 to Henkin et al. discloses apparatus in which a discharge jet is moved through a complex nonlinear and noncircular path to enhance the hydrotherapeutic properties. A jet nozzle is guided along a slot defining the complex path, and is propelled by a component of thrust developed as water is discharged through the nozzle.

U.S. Pat. No. 4,715,071, also issued Henkin et al., discloses another Version of the apparatus, in which a discharge jet follows a circular path. A conduit having a supply section, an intermediate section and a discharge section is mounted for rotation about the axis of the supply section. The discharge section is inclined at an acute angle to a plane through the supply and intermediate sections, resulting in a tangential thrust component that spins the conduit about the supply section axis. Unfortunately, the conduit is also subject to a radial thrust component, and must be mounted on cylindrical bearings to resist forces transverse to the axis of rotation. These bearings are subject to significant wear and may pose maintenance problems and limit the potential life of the fixture. Moreover, this technique does not permit adjustment of the speed of rotation, except by controlling the flow rate. Perhaps even more important as a practical matter is that the devices disclosed in these patents differ structurally from conventional spa jets, to such a degree that they could not be easily or conveniently installed in an existing spa or tub, nor could they be interchanged with other jets in the same spa or tub.

It will be appreciated from the foregoing that there is still a significant need for a spa jet assembly with water-driven rotational capability, but with additional features that render it more practical and useful. Ideally, a rotatable spa jet should be easily used to retrofit an existing installation having conventional spa jet nozzles, should have the ability to be adjusted in speed independently of the flow rate, and should be virtually maintenance free. The present invention meets these requirements and has additional advantages, as will become apparent from the following summary.

SUMMARY OF THE INVENTION

The present invention resides in a spa jet assembly having multiple, balanced water jets that rotate automatically at a speed that is controllable independently of the flow rate. Briefly, and in general terms, the assembly of the invention includes a generally cylindrical hollow body, having an open forward end portion and a rear end portion having means for introducing water under pressure into the body, a nozzle rotor and an nozzle retainer cage.

The nozzle rotor has front and rear ends and a rear end portion of generally cylindrical shape, to be received into the front end portion of the body for rotation about a common cylindrical axis. The nozzle rotor has a concave cavity formed in its rear end portion and at least two passages extending from the concave cavity to the front end of the rotor, the passages being symmetrical about the rotor axis, both in radial distance and in angular spacing. The nozzle retainer cage is secured to the body and has at least one member that extends across the front end of the rotor and has a thrust plate to apply a purely axial retaining force to the rotor. The nozzle rotor is rotated by the action of water passing through it, to produce rotation of the streams of water discharged from the passages in the nozzle rotor. The symmetry of the passages results in cancellation of radial forces on the nozzle rotor, and avoids the need for cylindrical bearings.

Preferably the nozzle assembly also includes a braking washer installed in contact with the rear end of the nozzle rotor, a compression spring installed in the body to apply force to the braking washer, and means for adjusting the force applied by the compression spring to the braking washer, to effect selective control of the speed of rotation of the nozzle rotor without affecting the rate of water flow through the nozzle rotor. In the preferred embodiment of the invention, the means for adjusting the force applied by the compression spring includes a threaded coupling between the nozzle retainer cage and the body, wherein rotation of the retainer cage moves the nozzle rotor axially with respect to the body and adjusts the amount of compression of the spring.

Also in the preferred embodiment of the invention, the means for adjusting the force applied by the compression spring further includes a detent mechanism to provide a tactile indication of the adjustment and to help retain a selected adjustment position. The detent mechanism may include a plurality of depressions formed in the inner surface of the body, and a detent arm affixed to the nozzle retainer cage and positioned to engage a selected one of the depressions but to be easily movable to another.

Another feature of the preferred embodiment is that it includes means for inhibiting accidental removal of the rotor retainer cage from the body. This may take the form of an additional recess formed in the inner surface of the body at a position to receive the detent arm prior to complete removal of the retainer cage from engagement with the body. The additional recess and the detent arm are shaped to prevent further movement of the retainer cage in one angular direction but to permit movement in the opposite angular direction.

The assembly may also be defined to include a housing into which the body is fitted for limited angular movement, the housing having a water supply port and an air supply port. The means for introducing water to the body also includes a water supply port in the body and an air supply port in the body. Flow through the nozzle assembly is manually controllable by manually turning the body within the housing, to affect alignment of the water and air supply ports in the body with the water and air supply ports in the housing.

In the illustrative embodiment of the invention, the nozzle retainer cage has two diametrically opposed members that extend radially across the front end of the nozzle rotor and support the thrust plate. Each of these cage members provides momentary interruption of the rotating water streams, to introduce a pulsating action. Ideally, the cage members extending across the front end of the nozzle rotor are beveled and tapered to minimize interruption of rotation of the nozzle rotor.

The presently preferred embodiment of the invention has two water passages in the nozzle rotor, and the two passages are aligned in two parallel planes and oriented to produce equal but opposite tangential thrust components to rotate the nozzle rotor. Other contemplated embodiments have two passages aligned in non-parallel planes, or two divergent passages in the same plane as the axis of rotation. Rotation may be induced in part or entirely by fins installed in the nozzle rotor.

It will be appreciated from the foregoing that the present invention provides a highly reliable rotating spa jet with many highly desirable features. A user of the spa jet can adjust the speed of rotation and the flow rate independently, to obtain a variety of therapeutic effects. Moreover, the almost perfectly balanced nozzle rotor is not subject to wear and is practically self-cleaning and maintenance free. Also, the jet assembly of the invention is easy to install in apparatus having existing plumbing and fixtures using conventional spa jets. Other aspects and advantages of the invention will become apparent from the following more detailed description, taken in conjunction with the accompanying drawings.

DESCRIPTION OF THE PREFERRED EMBODIMENTS

Figure 1B:
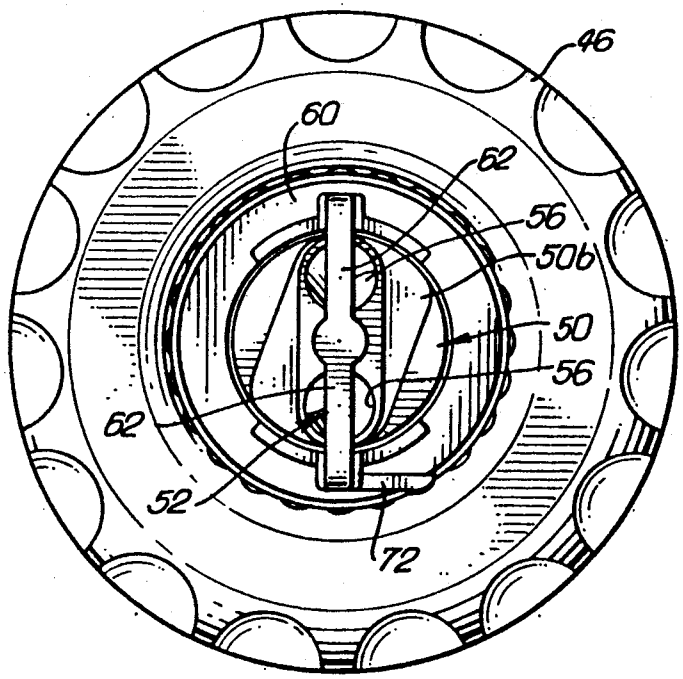
FIG. 1*b* is an end elevational view corresponding to FIG. 1*a;*

As shown in the drawings for purposes of illustration, the present invention is concerned with a novel spa jet assembly having multiple water jets that rotate automatically as water flows through the assembly. Prior rotating spa jets that have been proposed employed a single rotating jet that was subject to strong thrust forces transverse to the axis of rotation. Moreover, rotating spa jets prior to this invention have not been speed-controllable except in conjunction with the flow rate, and have been subject to various wear and maintenance problems.

In accordance with the present invention, a spa jet produces at least two water jets that may contribute to auto-rotation of a rotor in the assembly. Both axial and transverse forces on the rotor are substantially in balance, such that the rotor is stable in its spinning condition, and may be controlled in speed independently of the water flow rate.

Figure 1A:
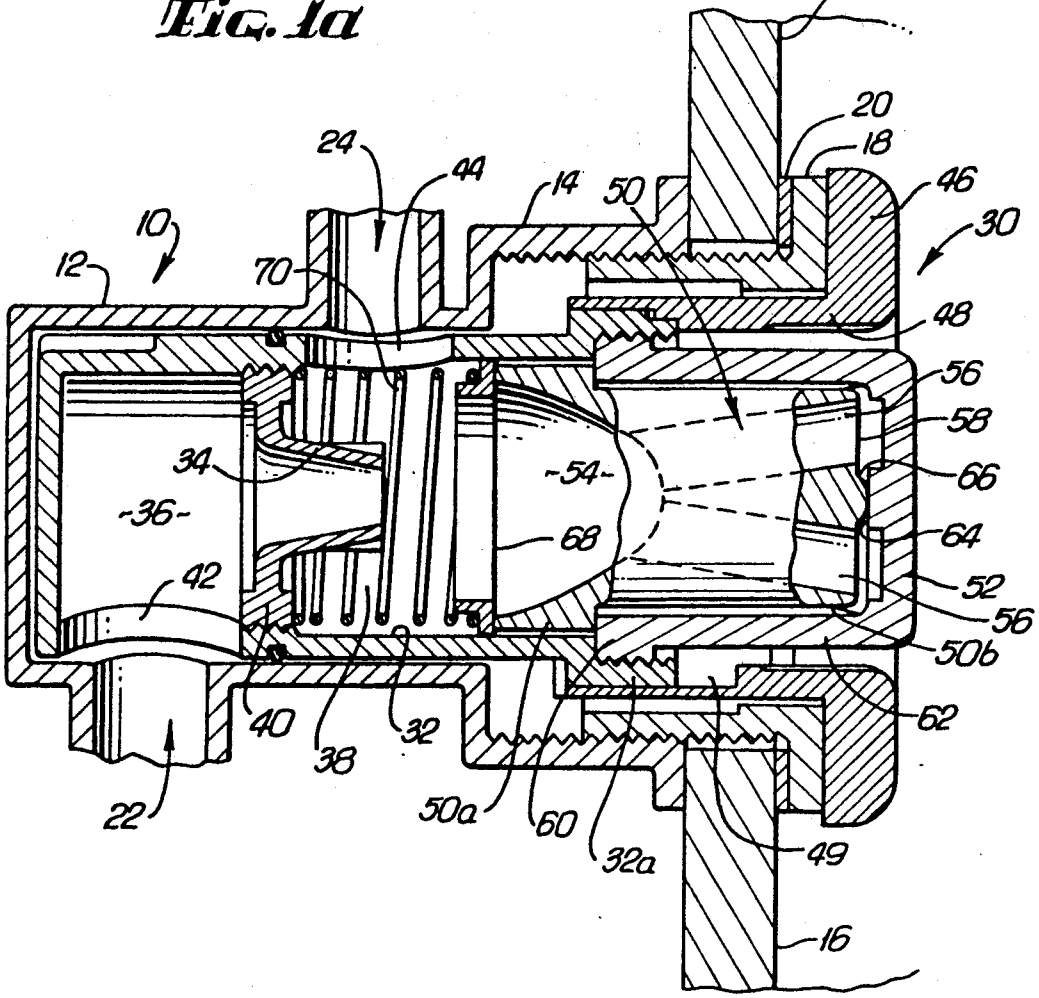
FIG. 1*a* is a longitudinal sectional view of the spa jet assembly of the invention in a typical installation.
Figure 2B:
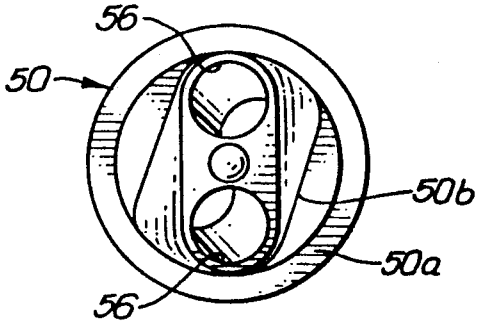
FIGS. 2*a*–2*c* are elevational views and FIG. 2*d* is a sectional view, of the preferred embodiment of the nozzle rotor of FIG. 1*a;*
Figure 2C:
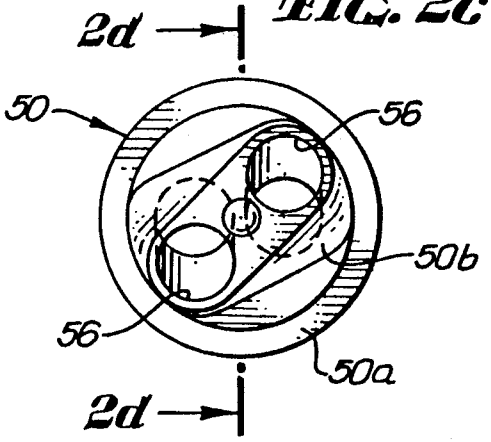
Figure 2A:
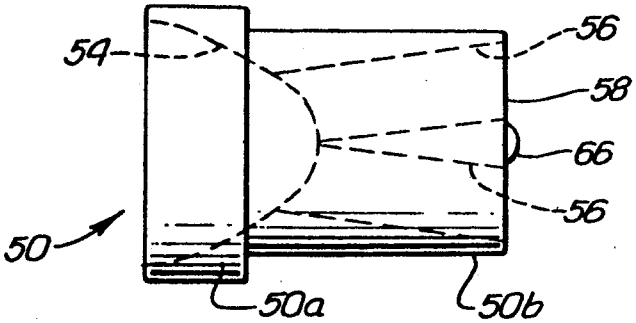
Figure 2D:
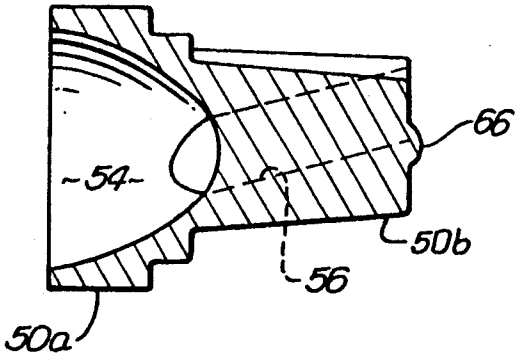

The salient features of the invention may be seen in the assembly view of FIG. 1*a*. A conventional spa jet housing, indicated by reference numeral 10, is basically cylindrical in shape, including rear cylindrical portion 12 and an integral front cylindrical portion 14 of increased diameter. The front portion 14 is internally threaded and is secured to a wall 16 of a tub or spa by an externally threaded securing ring 18. The securing ring 18 and the front portion 14 of the body have external flanges, between which the spa wall 16 is clamped. A sealing ring 20 is positioned between the flanged securing ring 18 and the spa wall 16. The rear portion 12 of the body 10 has a water supply port 22 near the rear end of the housing 10, and an air supply port 24 located further forward in the rear portion 12. These ports are permanently plumbed to water and air supply pipes (not shown).

A nozzle assembly 30 fits into the body 32 and includes all the remaining elements of FIG. 1 not yet specifically referred to. Conventional portions of the nozzle assembly 30 include a cylindrical body 32 that fits snugly in the rear portion 12 of the housing and extends some distance into the front portion 14 of the housing. A nozzle 34 is installed in the body 32, between the water inlet port 22 and the air inlet port 24, defining a water inlet chamber 36 on one side of the nozzle, and an air/water mixing chamber 38 on the other, downstream side of the nozzle. The nozzle 34 is basically conical in shape, presenting an open, wider end toward the water inlet chamber 22, and extending its narrower, tapered end into the mixing chamber 38. The nozzle 34 has an integral outer flange 40 that is threaded for attachment to an internally threaded portion of the body wall.

The body 32 has a water opening 42 that can be aligned with the water port 22, and an air opening 44 that can be aligned with the air port 24. When the body 32 is rotated through a limited angular range, water and air flow can be controlled to a limited degree by the degree of alignment between the openings 42, 44 in the body 32 and the ports 22, 24 in the housing of the assembly.

Another conventional component in the spa jet assembly of the invention is a rotatable flange 46. The flange 46 has an integral cylindrical sleeve 48, which is affixed to an expanded-diameter portion 32*a* of the body 32, at the forward end of the body. The sleeve 48 fits snugly inside the securing ring 18. Rotation of the flange 46 effects rotation of the entire body 32, and moves the water and air openings 42, 44 in relation to the water and air inlet ports 22, 24, permitting flow control in a conventional manner. A semicircular locking half-ring (not shown) fits in a semi-annular space indicated at 49 in FIG. 1*a*. A portion of the locking half-ring extends through the sleeve 48 and engages a shoulder in the securing ring 18 to prevent removal of the body 32 from the housing 12.

Up to this point in the detailed description, the parts described are used in existing spa jet assemblies. Usually, an internally threaded portion of the portion 32*a* of the body is used to install a single water nozzle (not shown) that can be moved manually to different angular positions.

There are two principal new elements to the assembly of the present invention. These are a rotor 50 and a rotor cage 52. The rotor 50 is a solid, generally cylindrical part, in which various cavities and passages are formed, as will be further discussed. As shown in FIG. 1*a*, the rotor has a rear end portion 50*a* that has a diameter to fit easily inside the body 32, and a forward portion 50*b* of irregular shape that extends forward to be almost flush with the flange 52.

As best shown in the elevation and sectional views of FIG. 2*a*–2*d*, the rotor 50 has concave cavity 54 formed symmetrically in its rear end portion 50*a*, the cavity being contiguous with the mixing chamber 38. Two relatively straight passages 56 are formed between the concave cavity 54 and the front end of the rotor, which is referred to by numeral 58. The passages in this preferred embodiment have axes that lie in parallel planes, as shown in the end views of FIGS. 2*b* and 2*c*, which show both ends of the passages as circles. Although in parallel planes, the axes of the passages 56 are inclined to each other by a selected small angle to provide a selected amount of tangential thrust.

Water discharged from the passages has three components of thrust: axial, tangential and radial. The axial components of the two streams of water cause a net rearward reaction force to be exerted on the rotor 50. Since the streams are symmetrical with respect to the central axis of the rotor, the two axial thrust forces may be considered as a single reaction force acting along the axis toward the rear end of the rotor. With appropriate design of the rotor 50 and passage 56 dimensions, the axial thrust reaction force can be balanced by the forward axial force exerted on the rotor water flowing into the concave cavity 54 of the rotor.

The radial components of the two water streams are equal in magnitude and opposite in direction. Consequently, the radial thrust reaction forces cancel and have no effect on rotation.

The tangential components of the two water streams also act in opposite directions. Therefore, their effect is to apply a turning moment to the rotor 50, with no net forces transverse to the axis of rotation.

The rotor 50 is retained in its installed position be the rotor cage 52. The cage 52 consists of a threaded ring 60, which engages the threaded section of the forward portion 32*a* of the body 32. Integral with the ring 60 are two diametrically spaced legs 62, which extend axially from the ring, along the length of the rotor 50, and then extend radially inward over the front end of the rotor, to meet at the axis of rotation. An axial bearing is formed by a rearward facing flat surface forming a thrust plate 64 located at the axis where the two legs 62 meet, and a raised part-spherical surface 66 centrally located on the forward end 58 of the rotor.

Located at the rear end of the rotor 50 is braking washer 68, which has a forward annular surface that bears on the rear end surface of the rotor. The braking washer 68 also has a rear-facing shoulder, and a light compression spring 70 is disposed between this shoulder and the nozzle 34 installed in the body 32. The spring 70 applies a controllable braking force to the rotor 50, through the braking washer 68. Speed control of the rotor is effected by rotating the rotor cage 52 manually, to translate the rotor, with the cage, axially with respect to the body 32. The further the cage 52 is screwed in towards the body 32, the greater will be the braking force and the slower the speed of rotation. Moreover, rotation may be completely stopped if desired.

An important consequence of the approach selected for securing the rotor 50 in the device is that rotation of the rotor is extremely stable. This is thought to be due, an almost perfect balancing of axial and radial forces acting on the rotor, and possibly to stabilization by gyroscopic action. In any event, the rotor 50 tends to "float" in its rotating position in the device, and bearing wear is minimized. The thrust plate 64 applies only an axial retaining force to the rotor 50, and no cylindrical bearing is needed. In addition, water entering the annular space surrounding the rotor acts as a lubricant and helps minimize the frictional forces that would, otherwise resist rotation.

Figure 3C:
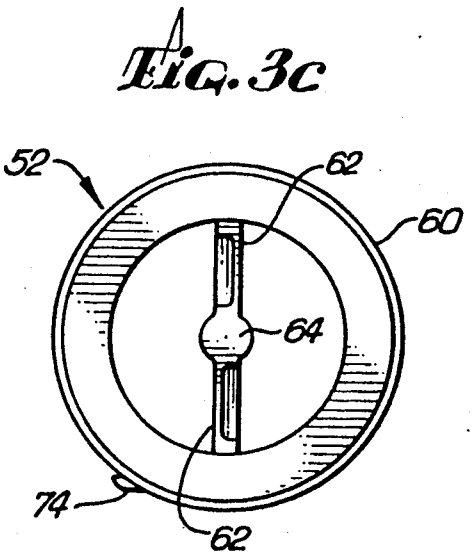
FIGS. 3*a*–3*d* are elevational views and FIGS. 3*e*–3*f* are sectional views of the rotor retainer cage of FIG. 1*a;*
Figure 3B:
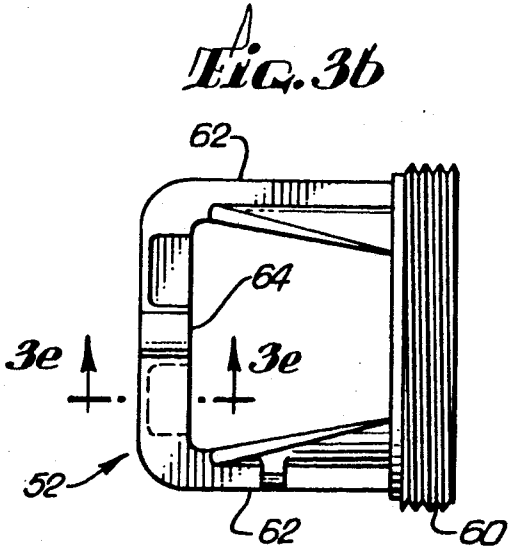
Figure 3A:
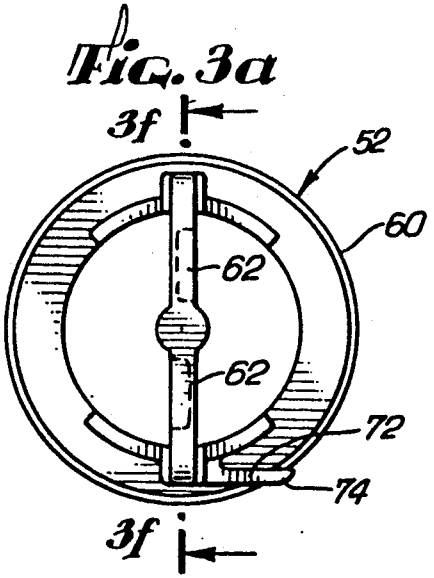
Figure 3F:
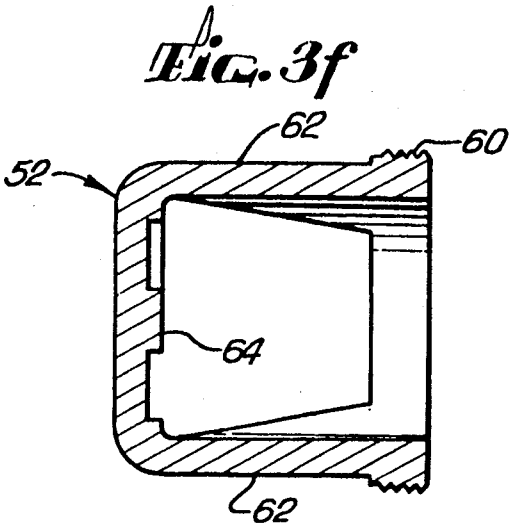
Figure 3E:
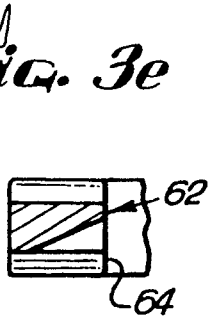
Figure 3D:
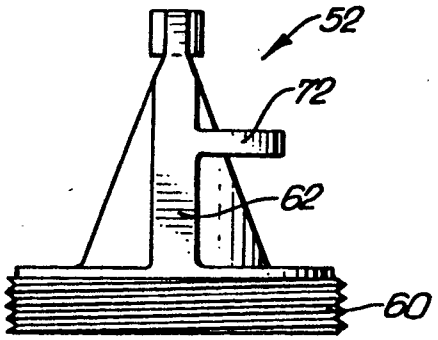

The radial portions of the legs 62 of the rotor cage 52 are specially contoured to perform the additional function of flow splitting. As best seen in FIG. 3*e*, each of these radial portions is beveled to provide a smooth interruption of flow as a water stream traverses one of the legs 62. The direction of bevel is opposite for each leg, to provide for cancellation of forces exerted on the cage 52. The effect of this flow interruption twice for every rotation of each water stream, is to provide a pulsating flow. The effect of the pulsation can be varied by changing the rotational speed, by rotating the cage 52, and by changing the flow rate, by rotating the outer flange 46. This pulsation action, taken together with the rotation of the streams, has a massaging or therapeutic effect.

The material used for the rotor 50, the thrust plate 64 and the brake washer 68 should be selected with care, both for compatibility and to minimize frictional resistance. In the presently preferred embodiment of the invention, the rotor 50 is made from a thermoplastic polyester material, such as DuPont Delrin 900 or General Electric Valox 310. Polyesters of this type have a very hard surface, and low frictional resistance, due in part to the presence of carnauba wax in the composition of the material. The thrust plate 64 is made from an acetal homopolymer, made by a number of different companies, such as DuPont. Acetal provides a hard, slick surface and excellent bearing characteristics. The same material is used for the brake washer 68, to provide smooth and reliable braking action with low wear.

Figure 4:
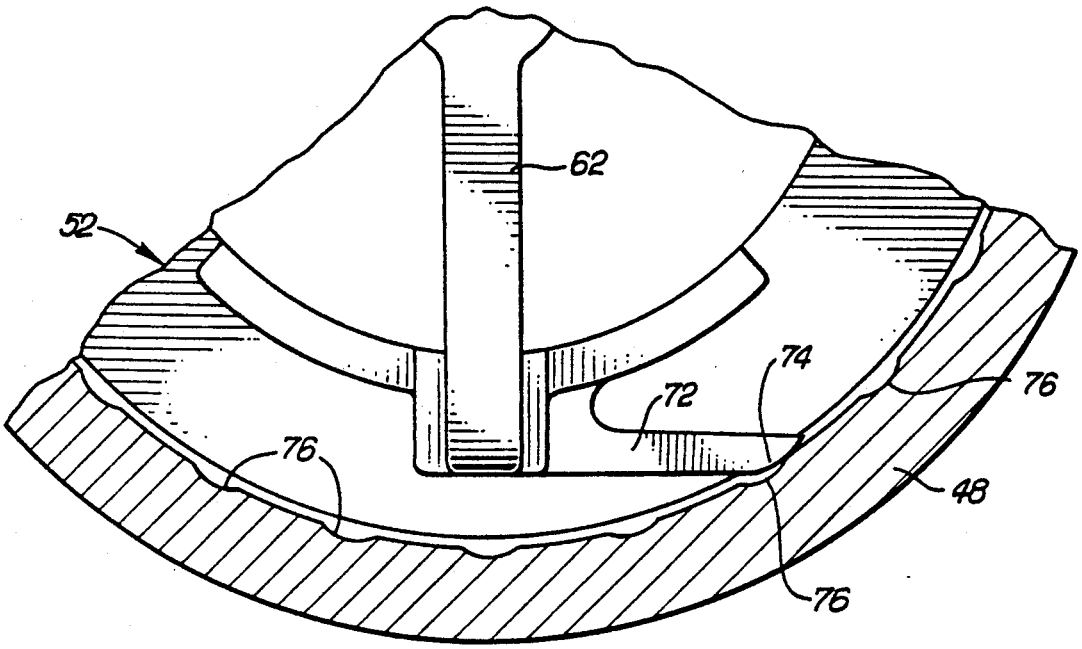
FIG. 4 is an enlarged and fragmentary view of a portion of the FIG. 1*a* assembly, showing a detent mechanism for rotor speed control.

In the presently preferred embodiment of the invention, adjustment of the braking action is facilitated by a detent mechanism, as best shown in FIG. 4. Integral with one leg 62 of the retainer cage 52 is a detent arm 72 extending perpendicular to the radial direction and having a curved end 74. The other part of the detent mechanism is a series of concave depressions 76 formed on the inside cylindrical surface of the sleeve 48 that is integral with the flange 46. The detent arm 72 is biased into engagement with one of the depressions 76, but the retainer cage 52 may be rotated to a new angular position, the detent arm being bent slightly as it passes through a position between any two adjacent depressions. The retaining cage 52 may be rotated as needed to adjust the speed of rotation of the rotor 50, with the detent mechanism providing a measure of tactile feedback to the user making the adjustment. The detent mechanism also facilitates return to a desired setting, in a repeatable manner.

Figure 5:
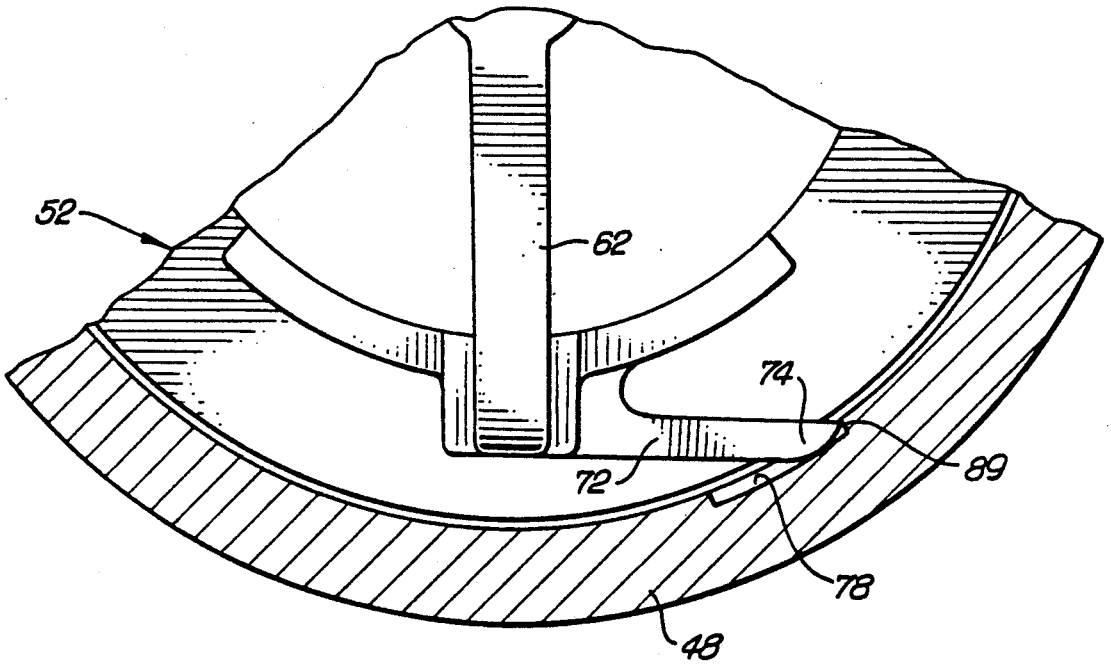
FIG. 5 is an enlarged and fragmentary view of a portion of the FIG. 1*a* assembly, showing a mechanism for inhibiting accidental removal of the rotor retainer age from the assembly.

A related feature discourages, but does not prevent, accidental complete removal of the rotor retainer cage 52 from the body 32 and is shown in FIG. 5. Immediately prior to reaching a point at which the cage 52 will be completely disengaged from the body 32, the detent arm 72 engages a recess 78 in the inner surface of the sleeve 48. Because the curved surface 74 of the detent arm 72 is not symmetrical, the end of the arm abuts a shoulder 89 in the recess 78 when any attempt is made to rotate the cage 52 further in a counterclockwise direction. Rotation in the clockwise direction is possible, because of the curved surface 74, which rides up out of the recess 78. Complete removal of the cage 52 is still possible, by inserting a tool, such as a screwdriver, to engage the detent arm 72 and bend it clear of the recess while further rotating the cage.

The invention has a number of advantages in addition to providing a reliable rotating and pulsating pair of water jets, with independent speed and flow control. First, the nozzle assembly 30, including the braking washer 68 and spring 70, may be easily installed to retrofit an existing spa jet having a conventional single water stream that is controllable only in direction. Because this retrofitting operation does not require tools, except a screwdriver to remove a jet of the old type or to release the cage 52 in the new type, spa jets of this new rotating type can be moved manually by a user from one location to another. Moreover, no special new plumbing or niche-forming is needed to retrofit an existing spa with the new rotating jets. Another advantage is that the new rotating jets are operational at a wide range of flow rates, typically from two to ten gallons per minute of water, or water and air mixture. The device also works equally well by aspirating air at atmospheric pressure, or by forcing air into the device with a blower. Finally, the nozzle rotor 50 is self-cleaning during operation because there is sufficient clearance around its perimeter to allow for continuous flushing of the nozzle. Moreover, contact between the nozzle rotor 50 and the thrust plate 64 is in the center of the rotor, and centrifugal force keeps the central area free of any accumulation of debris.

Figure 6B:
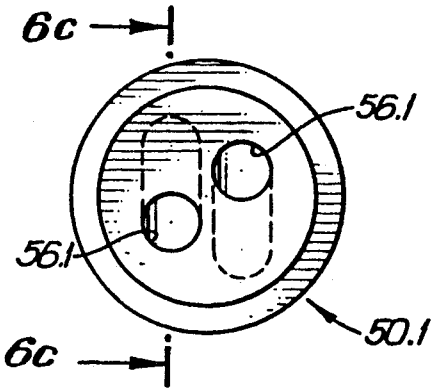
FIGS. 6*a*–6*b* are elevational views and FIG. 6*c* is a sectional view of another embodiment of the nozzle rotor.
Figure 6C:
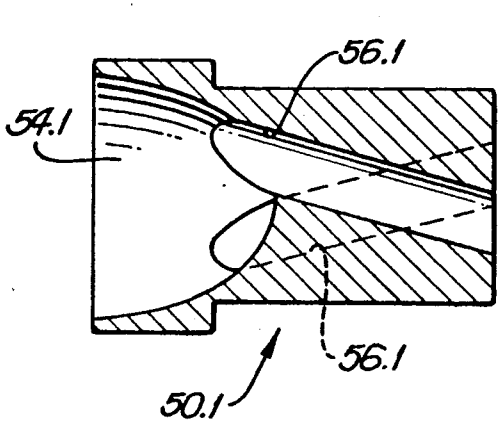
Figure 6A:
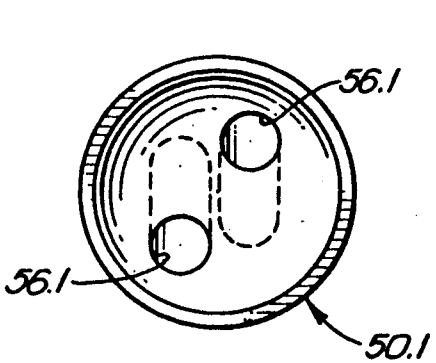

Although the preferred embodiment of the rotor 50 has been described above, other variant forms appear to work just as well, or could be made to work just as well with a little experimentation. FIGS. 6*a–c* show one such form of the rotor, indicated as 50.1. It also has two straight passages 56.1 of which the axes are on parallel planes. The only significant differences are a slightly longer rotor and a cylindrical forward end portion of the rotor.

Figures 7A, 7B, 7C:
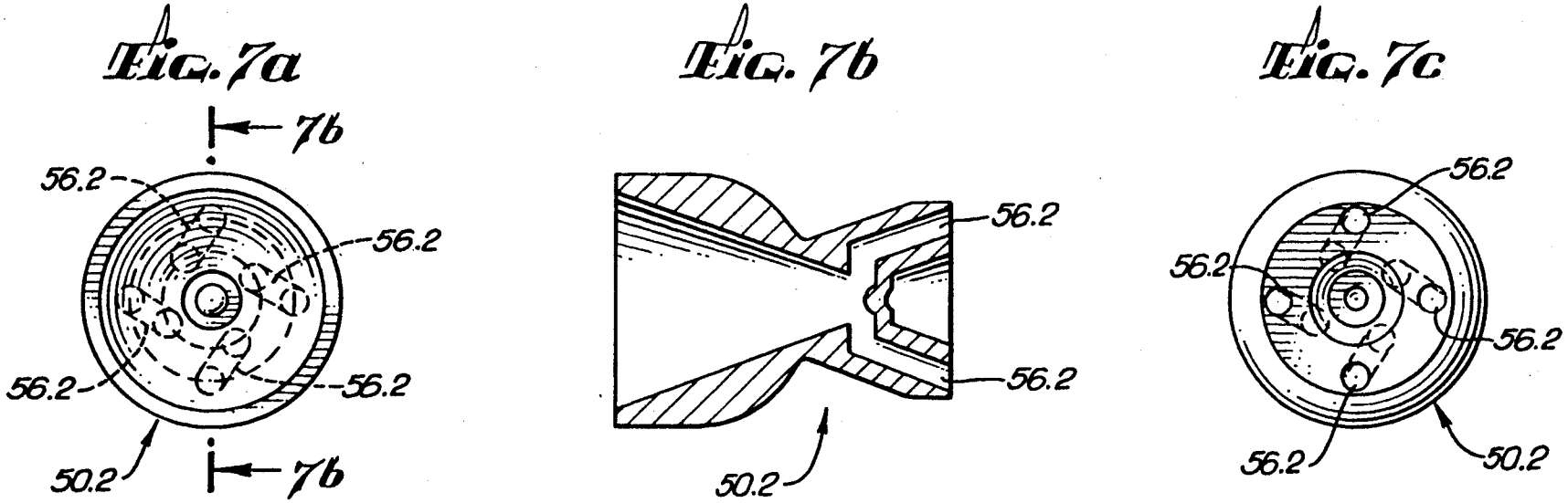
FIGS. 7*a*–7*b* are elevational views and FIG. 7*c* is a sectional view of another embodiment of the nozzle rotor, having four discharge streams.
Figure 8B:
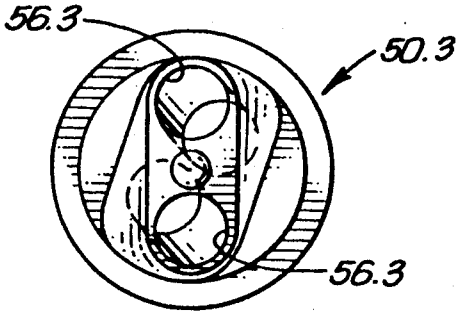
FIGS. 8*a*–8*d* are elevational views and FIG. 8*e* is a sectional view of another embodiment of the nozzle rotor, including fins to assist in inducing rotation.
Figure 8E:
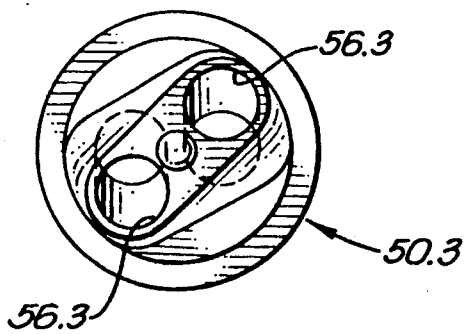
Figure 8A:
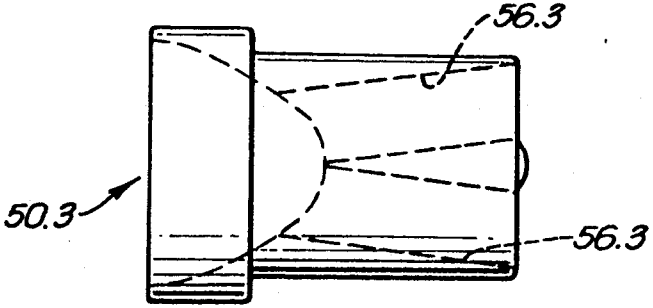
Figure 8D:
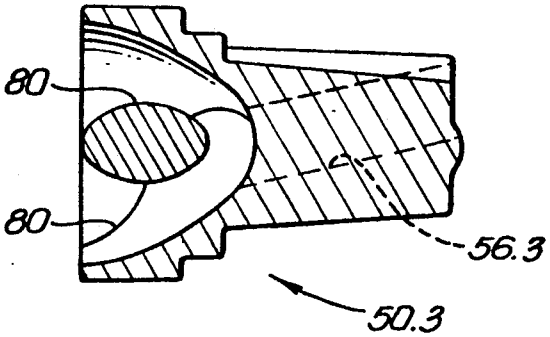
Figure 8C:
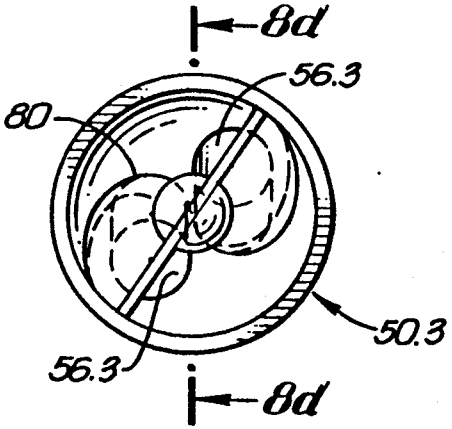

FIGS. 7*a–c* show another form of the rotor, indicated as 50.2, from which four streams of water exit from four passages 56.2 angularly spaced about the rotor and aligned in two pairs of parallel planes. Again there is balancing of radial components of thrust from the four streams.

FIGS. 8*a–e* show another version of the rotor 50.3, in which fins 80 are installed in the concave cavity to smooth the flow of water into the passages 56.3 and to add an additional rotational force component to the rotor.

The rotor design is not limited to having the passages 56 in parallel planes. They may instead be in planes that intersect or, if fins are installed to rotate the rotor, the passages may be parallel and provide no tangential thrust component at all.

It will be appreciated from the foregoing that the present invention represents a significant advance in the field of hydrotherapy equipment and techniques. In particular, the invention provides a water-driven rotating and pulsating spa jet that is easily and independently controllable in speed of rotation and flow rate, is simple to install and replace, and is relatively maintenance free. It will also be appreciated that, although an embodiment of the invention has been described in detail for purposes of illustration, various modifications may be made without departing from the spirit and scope of the invention. Accordingly, the invention is not to be limited except as by the appended claims.

We claim:

1. A water-driven rotatable hydrotherapy nozzle assembly, comprising:

a generally cylindrical hollow body, having an open forward end portion and a rear end portion having means for introducing water under pressure into the body;

a nozzle rotor having front and rear ends and a rear end portion of generally cylindrical shape, to be received into the front end portion of the body for rotation about a common cylindrical axis, and wherein the nozzle rotor has a concave cavity formed in its rear end portion and at least two passages extending from the concave cavity to the front end of the rotor, the passages being symmetrical about the rotor axis, both in radial distance and in angular spacing; and a nozzle retainer cage, secured to the body and having at least one member that extends across the front end of the rotor and has a thrust plate to apply a purely axial retaining force to the rotor;

and wherein the nozzle rotor is rotated by the action of water passing through it, to produce rotation of the streams of water discharged from the passages in the nozzle rotor, whereby the symmetry of the passages results in cancellation of radial forces on the nozzle rotor, and avoids the need for cylindrical bearings.

2. A water-driven rotatable hydrotherapy nozzle assembly as defined in claim 1, and further comprising:

a braking washer installed in contact with the rear end of the nozzle rotor;

a compression spring installed in the body to apply force to the braking washer; and means for adjusting the force applied by the compression spring to the braking washer, to effect selective control of the speed of rotation of the nozzle rotor without affecting the rate of water flow through the nozzle rotor.

3. A water-driven rotatable hydrotherapy nozzle assembly as defined in claim 2, wherein:

the means for adjusting the force applied by the compression spring includes a threaded coupling between the nozzle retainer cage and the body, wherein rotation of the retainer cage moves the nozzle rotor axially with respect to the body and adjusts the amount of compression of the spring.

4. A water-driven rotatable hydrotherapy nozzle assembly as defined in claim 3, wherein the means for adjusting the force applied by the compression spring further includes:

a detent mechanism to provide a tactile indication of the adjustment and to help retain a selected adjustment position.

5. A water-driven rotatable hydrotherapy nozzle assembly as defined in claim 4, wherein the detent mechanism includes:

a plurality of depressions formed in the inner surface of the body; and a detent arm affixed to the nozzle retainer cage and positioned to engage a selected one of the depressions but to be easily movable to another.

6. A water-driven rotatable hydrotherapy nozzle assembly as defined in claim 5, and further comprising:

means inhibiting accidental removal of the rotor retainer cage from the body.

7. A water-driven rotatable hydrotherapy nozzle assembly as defined in claim 6, wherein the means inhibiting accidental removal of the rotor retainer cage includes:

an additional recess formed in the inner surface of the body at a position to receive the detent arm prior to complete removal of the retainer cage from engagement with the body, wherein the additional recess and the detent arm are shaped to prevent further movement in one angular direction of the retainer cage but to permit movement in the other angular direction.

8. A water-driven rotatable hydrotherapy nozzle assembly as defined in claim 2, wherein:

the assembly further comprises a housing into which the body is fitted for limited angular movement, the housing having a water supply port and an air supply port;

the means for introducing water to the body includes a water supply port in the body and an air supply port in the body; and flow through the nozzle assembly is manually controllable by turning the body within the housing, to affect alignment of the water and air supply ports in the body with the water and air supply ports in the housing.

9. A water-driven rotatable hydrotherapy nozzle assembly as defined in claim 1, wherein:

the nozzle retainer cage has two diametrically opposed members that extend radially across the front end of the nozzle rotor and support the thrust plate; and each of these cage members provides momentary interruption of the rotating water streams, to introduce a pulsating action.

10. A water-driven rotatable hydrotherapy nozzle assembly as defined in claim 9, wherein:

the cage members extending across the front end to the nozzle rotor are beveled and tapered to minimize interruption of rotation of the nozzle rotor.

11. A water-driven rotatable hydrotherapy nozzle assembly as defined in claim 1, wherein:

the water passages in the nozzle rotor are oriented to balance radial components of thrust acting on the rotor.

12. A water-driven rotatable hydrotherapy nozzle assembly as defined in claim 11, wherein:

there are two water passages in the nozzle rotor, aligned in two parallel planes and oriented to provide balanced thrust components that result in an angular turning moment applied to rotate the nozzle rotor.

13. A water-driven rotatable hydrotherapy nozzle assembly as defined in claim 11, wherein:

there are two water passages in the nozzle rotor, aligned in two non-parallel planes and oriented to produce equal but opposite tangential thrust components to rotate the nozzle rotor.

14. A water-driven rotatable hydrotherapy nozzle assembly as defined in claim 1, wherein:

the water passages are dimensioned to substantially balance the axial components of thrust resulting from water discharged from the nozzle rotor with the axial component of force resulting from water entering the nozzle rotor.

15. A water-driven rotatable hydrotherapy nozzle assembly as defined in claim 1, wherein:

the water passages diverge from the axis of rotation and lie in the same plane as the axis; and the rotor includes at least one fin in the concave cavity to induce rotation of the rotor as water flows through it.

16. A water-driven rotatable hydrotherapy nozzle assembly, comprising:

a generally cylindrical hollow body, having an open forward end portion and a rear end portion having a water supply port and an air supply port;

a housing into which the body is fitted for limited angular movement, the housing having a water supply port and an air supply port, wherein angular movement of the body within the housing effects limited control of the flow rate of water and air, if any is supplied, through the nozzle assembly;

a nozzle rotor having front and rear ends and a rear end portion of generally cylindrical shape, to be received into the front end portion of the body for rotation about a common cylindrical axis, and wherein the nozzle rotor has a concave cavity formed in its rear end portion and two passages extending from the concave cavity to the front end of the rotor, the passages being symmetrical about the rotor axis, both in radial distance and in angular spacing, to produce equal but opposite radial thrust components and tangential thrust components to provide a turning moment;

a nozzle retainer cage, secured to the body and having two members that extend across the front end of the rotor and support a thrust plate to apply a purely axial retaining force to the rotor; and means for applying a selected braking force to the nozzle rotor, to control its speed of rotation independently of the rate of flow of the water;

and wherein the nozzle rotor: is rotated by the action of water passing through it, to produce rotation of the streams of water discharged from the passages in the nozzle rotor, whereby the symmetry of the passages results in cancellation of radial forces on the nozzle rotor, and avoids the need for cylindrical bearings.

17. A water-driven rotatable hydrotherapy nozzle assembly as defined in claim 16, wherein the means for applying a selected braking force includes:

a braking washer installed in contact with the rear end of the nozzle rotor;

a compression spring installed in the body to apply force to the braking washer; and means for adjusting the force applied by the compression spring to the braking washer, to effect selective control of the speed of rotation of the nozzle rotor without affecting the rate of water flow through the nozzle rotor.

18. A water-driven rotatable hydrotherapy nozzle assembly as defined in claim 16, wherein:

the means for adjusting the force applied by the compression spring includes a threaded coupling between the nozzle retainer cage and the body, wherein rotation of the retainer cage moves the nozzle rotor axially with respect to the body and adjusts the amount of compression of the spring and thus the force on the braking washer.

19. A water-driven rotatable hydrotherapy nozzle assembly as defined in claim 18, wherein the means for adjusting the force applied by the compression spring further includes:

a detent mechanism to provide a tactile indication of the adjustment and to help retain a selected adjustment position.

20. A water-driven rotatable hydrotherapy nozzle assembly as defined in claim 19, wherein the detent mechanism includes:

a plurality of depressions formed in the inner surface of the body; and a detent arm affixed to the nozzle retainer cage and positioned to engage a selected one of the depressions but to be easily movable to another.

21. A water-driven rotatable hydrotherapy nozzle assembly as defined in claim 20, and further comprising:

means inhibiting accidental removal of the rotor retainer cage from the body.

22. A water-driven rotatable hydrotherapy nozzle assembly as defined in claim 21, wherein the means inhibiting accidental removal of the rotor retainer cage includes:

an additional recess formed in the inner surface of the body at a position to receive the detent arm prior to complete removal of the retainer cage from engagement with the body, wherein the additional recess and the detent arm are shaped to prevent further movement in one angular direction of the retainer cage but to permit movement in the other angular direction.

23. A water-driven rotatable hydrotherapy nozzle assembly as defined in claim 16, wherein:

the two members of the nozzle retainer cage that extend across the front end of the rotor are diametrically opposed; and each of these cage members provides momentary interruption of the rotating water streams, to introduce a pulsating action.

24. A water-driven rotatable hydrotherapy nozzle assembly as defined in claim 23, wherein:

the cage members extending across the front end to the nozzle rotor are beveled and tapered to minimize interruption of rotation of the nozzle rotor.

25. A water-driven rotatable hydrotherapy nozzle assembly as defined in claim 17, wherein:

the two water passages in the nozzle rotor are aligned in two parallel planes and oriented to produce equal but opposite tangential thrust components to rotate the nozzle rotor.

26. A water-driven rotatable hydrotherapy nozzle assembly as defined in claim 17, wherein:

the two water passages in the nozzle rotor are aligned in two non-parallel planes and oriented to produce equal but opposite tangential thrust components to rotate the nozzle rotor.

27. A water-driven rotatable hydrotherapy nozzle assembly as defined in claim 17, wherein:

the water passages are dimensioned to substantially balance the axial components of thrust resulting from water discharged from the nozzle rotor with the axial component of force resulting from water entering the nozzle rotor.

* * * * *